US005553650A

United States Patent [19]

Jelic

[11] Patent Number: 5,553,650

[45] Date of Patent: Sep. 10, 1996

[54] CHILD SAFETY DEVICE FOR LOOPED CORDS

[75] Inventor: Ralph Jelic, Valencia, Pa.

[73] Assignee: Verosol USA Inc., Pittsburgh, Pa.

[21] Appl. No.: 372,165

[22] Filed: Jan. 12, 1995

Related U.S. Application Data

[63] Continuation-in-part of Ser. No. 293,021, Aug. 19, 1994.

[51] Int. Cl.[6] ..... E06B 9/38

[52] U.S. Cl. ..... 160/178.1; 160/173; 16/122

[58] Field of Search ..... 30/278, 280, DIG. 3; 16/122, 216, 218, 219; 160/178.1 R, 173 R

[56] References Cited

U.S. PATENT DOCUMENTS

| | | | |
|---|---|---|---|
| 2,041,386 | 5/1936 | Van Laanen, Jr. | 30/278 X |
| 3,485,285 | 12/1969 | Anderle | 160/168 |
| 4,831,734 | 5/1989 | De Ruyter et al. | 30/278 X |
| 4,909,298 | 3/1990 | Langhart et al. | 160/178.1 R |
| 5,184,660 | 2/1993 | Jelic | 160/171 |
| 5,309,802 | 5/1994 | Mammosser | 30/278 X |
| 5,413,580 | 5/1995 | Stephenson . | |

*Primary Examiner*—Blair Johnson

*Attorney, Agent, or Firm*—Buchanan Ingersoll, P.C.; Lynn J. Alstadt

[57] ABSTRACT

A safety device for use on looped cords of the type frequently used in pleated shades, roman shades and venetian blinds has a body containing an anvil and adjacent cord channel. The cord channel is sized to permit at least one cord to pass therethrough. A plunger having a blade attached thereto is positioned so that the blade is above the anvil. A spring attached to the plunger and the body pushes the blade away from the anvil, such that a force acting on the plunger in a direction toward the anvil will cause the blade to move toward the anvil cutting any cords within the cord channel.

8 Claims, 7 Drawing Sheets

CHILD SAFETY DEVICE FOR LOOPED CORDS

CROSS REFERENCE TO RELATED APPLICATION

This is a continuation in part of U.S. patent application Ser. No. 08/293,021 filed Aug. 19, 1994.

BACKGROUND OF THE INVENTION

1. Field of the Invention

This invention relates generally to looped lift cords of the type used in window coverings such as pleated shades, venetian blinds and Roman shades, and more particularly, the invention relates to safety devices used with such lift cords.

2. Description of the Prior Art

Pleated shades, Roman shades and venetian blinds typically have window covering material or blind slats extending between a headrail and bottom rail and two or more lift cords connected to the bottom rail. Within the headrail is some type of cord locking device. Typically, two or more lift cords are connected at one end to the bottom rail, and extend up through the window covering material or blind slats into the headrail. The lift cords then pass through a cord locking device and out of the headrail such that an opposite end of the lift cords is accessible to an operator. These window shades and blinds are typically raised by the operator pulling on the accessible portion of the lift cords and are lowered by releasing the lift cords. Because all lift cords must move in unison, the lift cords are typically tied together or otherwise looped as can be seen in FIG. 1. The lift cords often extend downward from the headrail to within a few feet of floor level.

A second type of lift mechanism for window coverings has a spool within the headrail to which the lift cords are attached. The window covering is raised and lowered by winding and unwinding the lift cords around the spool. A continuous looped cord is provided around one end of the spool. The spool is rotated by pulling on one of the two sides of the loop depending upon whether clockwise or counter-clockwise rotation is desired. Although this lift mechanism operates differently from the first described mechanism, a window covering containing this second type of mechanism would also look very similar to the window covering shown in FIG. 1. This type of lift mechanism is disclosed in my U.S. Pat. No. 5,184,660.

Looped lift cords extending from a window treatment such as is shown in FIG. 1 present an attractive danger to infants or children who may play with the lift cords. There have been several instances in which children and infants have become entangled in such cords and accidentally hanged.

In the past, attempts to reduce the danger associated with these lift cords have focused on moving the lift cords out of the accessible range of infants such as by tying or clipping the cords to shorten them or otherwise moving the lift cords away from floor level and away from the infant's reach. Moving the cords out of the way after use is troublesome, and the operator must remember to move the cords after each use. Other attempts have focused on a detachable connection of the ends of the lift cords such as is disclosed in U.S. Pat. No. 4,909,298 to Langhart et al. Detachable lift cords require a certain level of force to detach. Moreover, recent tests of the commercially available embodiment of the Langhart patent have shown that this product failed to detach in simulated entanglements. Moreover, a detachable tassel cannot be used with the spool type lift mechanism which requires continuous rotation of the looped cord around the spool.

Thus, there is a need in the industry for a safety device to reduce the danger associated with looped lift cords which is reliable and which does not require any separate actions by the operator. Such a device must operate efficiently, yet be aesthetically pleasing. It must be inexpensive and easy to install, particularly on window coverings which are hanging in a window.

The cords used for the first type of lift mechanism are typically made of woven cotton polyester materials. For the spool type lift mechanism the looped cord may be woven or may be a bead chain. There is a need for a safety device which can be used with both woven cords and bead chains.

SUMMARY OF THE INVENTION

I provide a safety device for reducing the dangers associated with looped lift cords of a window covering assembly. The device is easily fitted over the cord before, during or after installation of the window covering on a window.

The safety device generally has a main body containing a channel through which the looped cord travels, an anvil is present at the base of the channel. Above the anvil is a blade which is spring biased in the up position. Preferably, the blade is attached to a movable plunger. Alternatively, the blade can be positioned near the plunger. Should a child become entangled within the loop of the cord, that action would force the plunger to move the blade against the anvil thereby cutting that portion of the cord within the cord channel. In this way the loop is broken and the child is free.

The safety device preferably has a cover which fits over the cord channel to retain the looped cord therein. The cover is designed such that after the cord is placed in the channel and the cover is closed, the cover cannot be readily removed.

I prefer to use a V-shaped blade. This shape provides more efficient cutting action. Additionally, it is less likely that a person could cut himself with such a blade when installing the safety device. After the safety device is installed the blade is fully enclosed and poses no danger.

DETAILED DESCRIPTION OF THE PREFERRED EMBODIMENTS

The present invention can be used with any type of window covering which uses looped lift cords including pleated shades, roman shades and venetian blinds. Although the present preferred embodiments are shown and described in use with pleated shades, the invention is not so limited.

Figure 1:
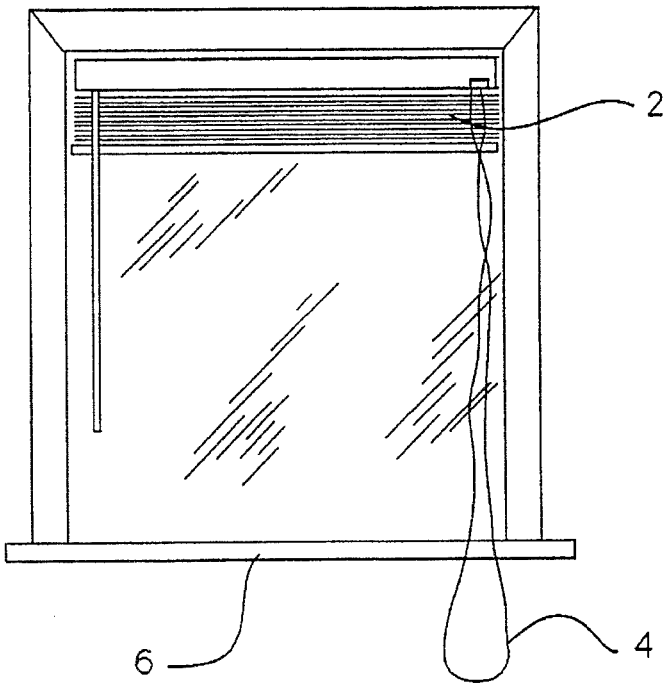
Fig.1. Prior Art
FIG. 1 is a prior art window shade assembly affixed to a window showing a looped lift cord.

An example of a window covering having a cord which forms a loop is shown in FIG. 1. This window treatment product 2 could be a pleated shade, roman shade or venetian blind. When the window covering is in an open position, the cord 4 typically extends below the window sill 6 and can be easily reached by young children.

Figure 2:
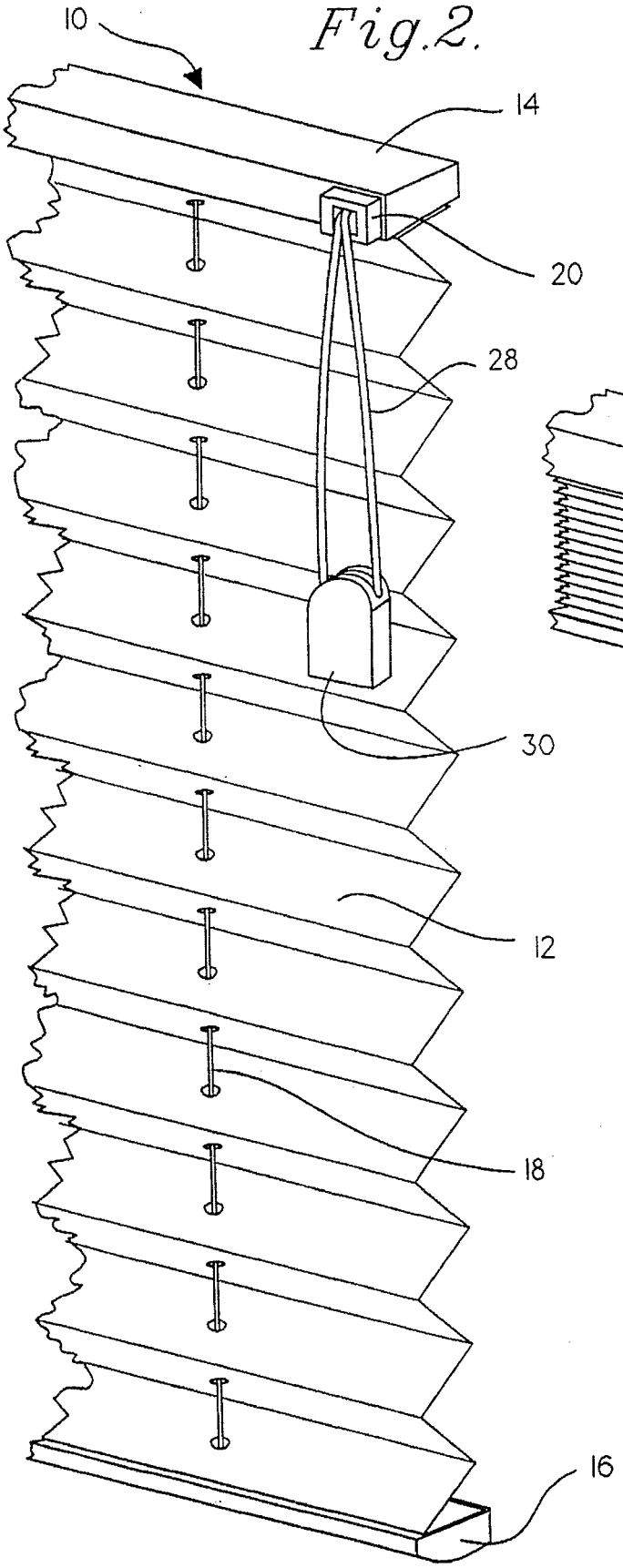
FIG. 2 is a perspective view of a present preferred safety device attached to a looped lift cord on a pleated shade which has been lowered to a closed position.
Figure 3:
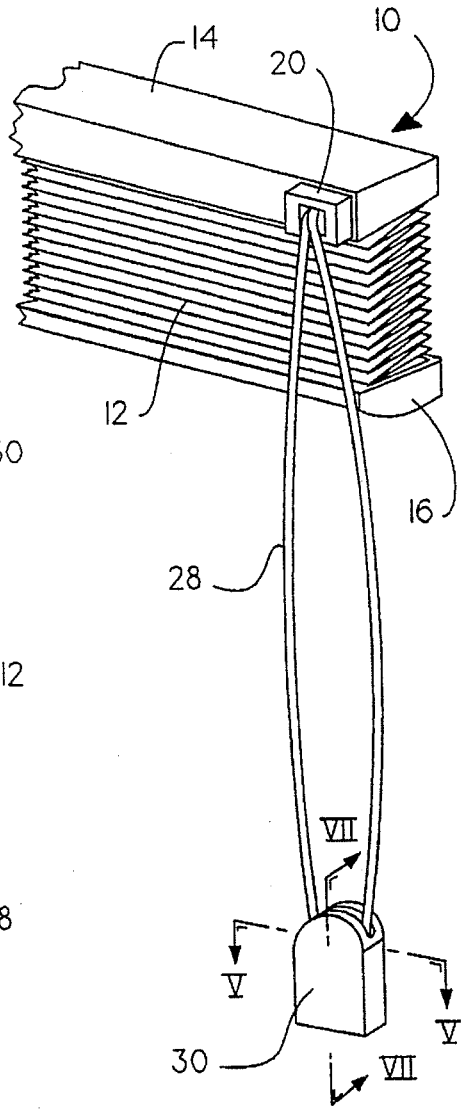
FIG. 3 is a view similar to FIG. 2 in which the window shade has been raised to an open position.
Figure 5:
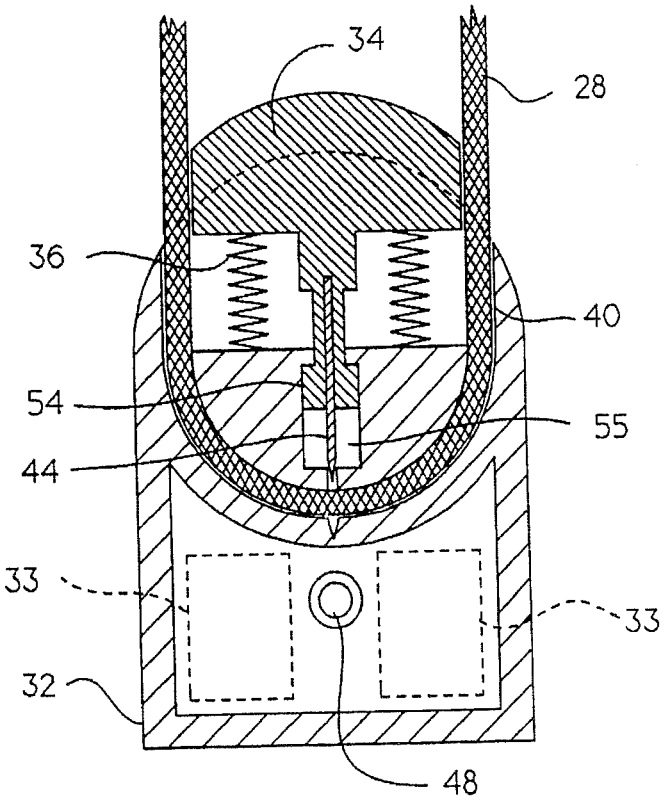
FIG. 5 is a cross-sectional view of the first preferred safety device shown in FIGS. 2 and 3 with the plunger in an up position taken along the lines V—V.

In FIGS. 2 and 3 a pleated shade 10 is shown in an open and closed position. The pleated shade typically has a top rail 14, bottom rail 16 and pleated material 12 therebetween. A lift cord 18 extends through the pleated material into the headrail. The lift cord may continue through the cord lock 20 forming a looped cord 28 and run back through the headrail and an opposite side (not shown) of the window covering to the bottom rail. Alternatively, the lift cord 18 may be attached to a spool (not shown) in the headrail about which the cord 18 is wrapped. A first present preferred embodiment of my safety device 30 is attached to the looped cord 28. The inside of the safety device 30 is shown in FIGS. 4 thru 7. Referring now to these figures, the safety device 30 generally is comprised of a main body 32 having an anvil 42 and adjacent cord channel 40 through which the looped cord 28 passes. If desired, weights 33 (shown in chain line in FIG. 5) may be placed within the main body 32. Positioned above the anvil is a plunger 34 having a blade 44 attached thereto. Bosses 54 are positioned on the plunger 34. These bosses are sized to fit within cavity 55 and permit the plunger to move the blade 44 into the cord channel 40. This arrangement prevents plunger 34 from being pulled from the body 32 after the cover 46 has been attached. At least one spring 36 is provided between the plunger 34 and the main body 32 to bias the plunger away from the cord channel 40. When a force acts upon the plunger 34 in the direction of the anvil 42, the plunger 34 will move to the position shown in FIG. 6. During that movement the blade 44 passes through the cord channel 40, and cuts the looped cord 28 passing therethrough into two portions 28*a* and 28*b*. Since the severed portions 28*a* and 28*b* of the cord can freely pass through the cord channel 40, the safety device 30 will fall from the severed cord and the loop will be broken. A child or animal that had been caught in the loop is freed as the severed portions 28*a* and 28*b* of the cord separate. At that point the owner of the shade will be required to replace the looped lift cord but accidental hanging or other tragedy has been averted.

Figure 7:
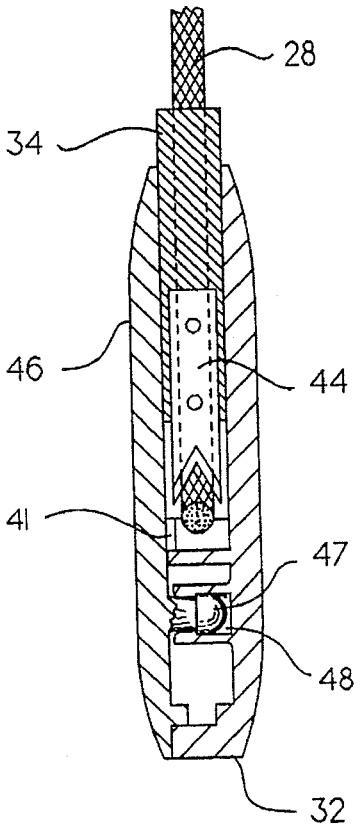
FIG. 7 is a cross-sectional view taken along the line VII—VII of FIG. 2.
Figure 6:
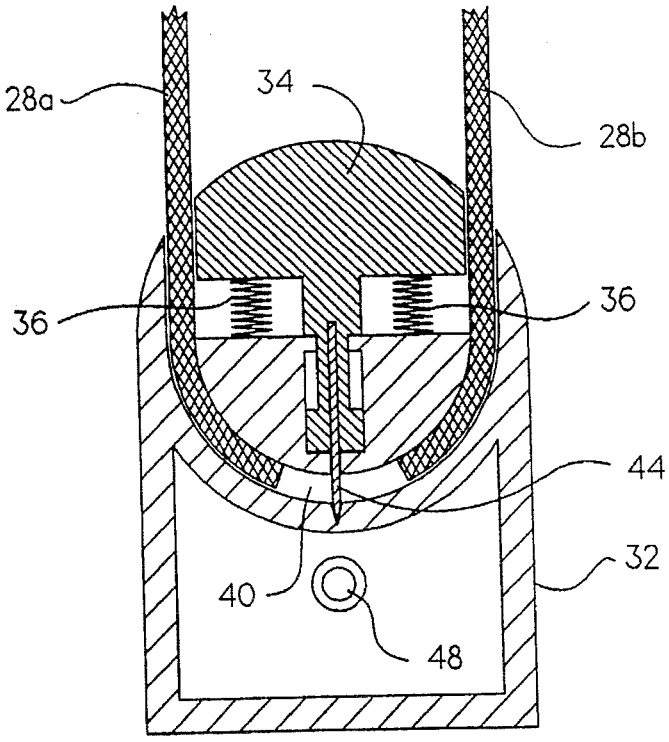
FIG. 6 is a sectional view similar to FIG. 4 with the plunger in a depressed position.

As can be seen in FIG. 7 I prefer to provide a cover 46 which fits over the main body 32 and much of the plunger 34. The cover has a stake 47 which fits within a hole 48 in the main body 32. The stake 47 secures the cover 46 against the body 32 as shown by the dotted line in FIG. 4. Preferably, the stake 47 and hole 48 are sized and configured to prevent removal of the cover 46. Alternatively, one could use a screw in place of stake 47. Consequently, after the safety device has been placed on the looped cord 28 there is no access to the blade. I also prefer to provide a cord channel 41 within cover 46. This could be sized to carry a second cord or to complement cord channel 40 in receipt of a single cord. Alternatively, one could configure cord channel 40 to can carry two or more cords.

The child safety device preferably would be sold with the cover separate from the main body. The installer or owner of the window covering would lay the cord in the cord channel 40 then snap the cover 46 over the body 32.

Figure 4:
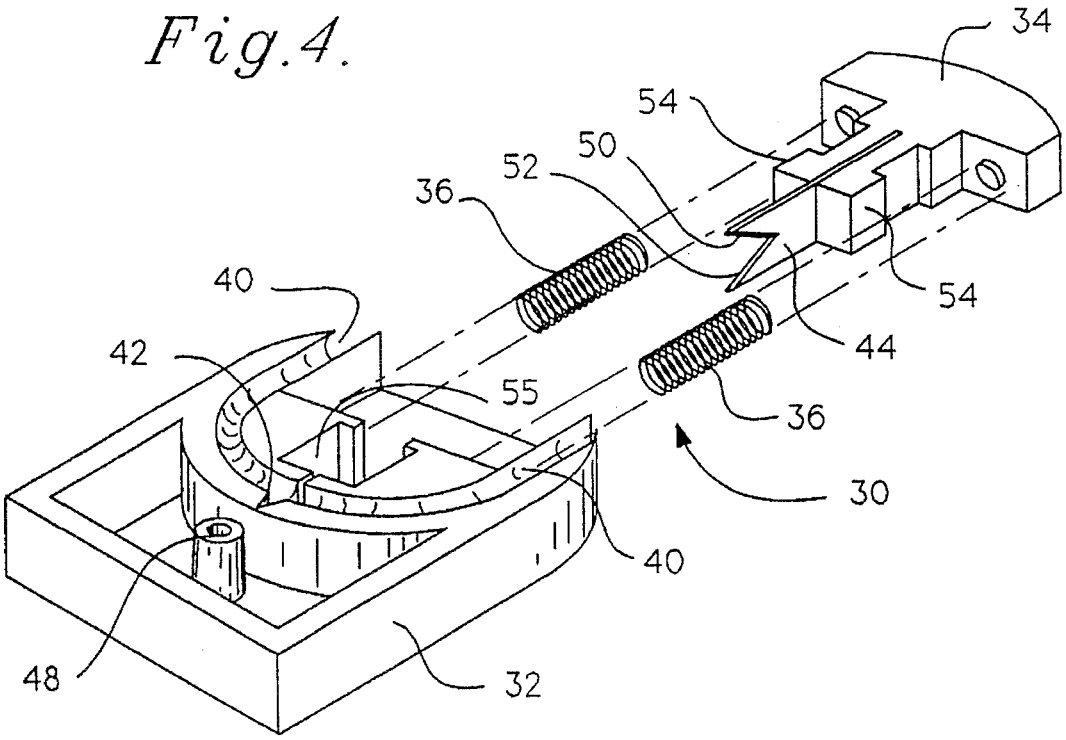
FIG. 4 is an exploded perspective view of the first preferred safety device in FIGS. 2 and 3 with the cover removed.
Figure 10:
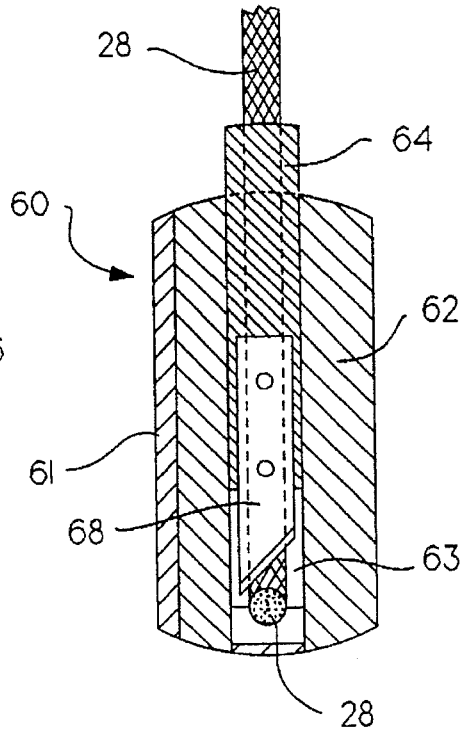
FIG. 10 is a sectional view taken along the line X—X of FIG. 8.

I prefer to use a V-shaped blade as shown most clearly in FIGS. 4 and 7. This shape has two opposed cutting edges 50 and 52. One could also use a single blade preferably angled as shown in the embodiment of FIG. 10. However, the V-shaped blade is less likely to cut the a finger of the person placing the cord in the channel. Moreover, one third to one half less force must be applied to cut a cord with the V-blade than is required to cut the cord with a straight blade.

Figure 8:
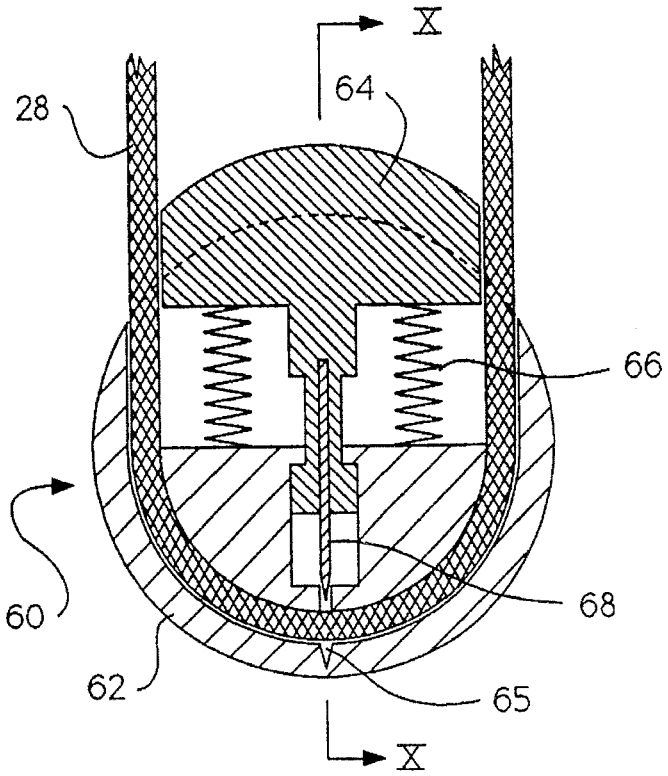
FIG. 8 is a cross-sectional view of a second present preferred embodiment of my safety device with the plunger in an up position.
Figure 9:
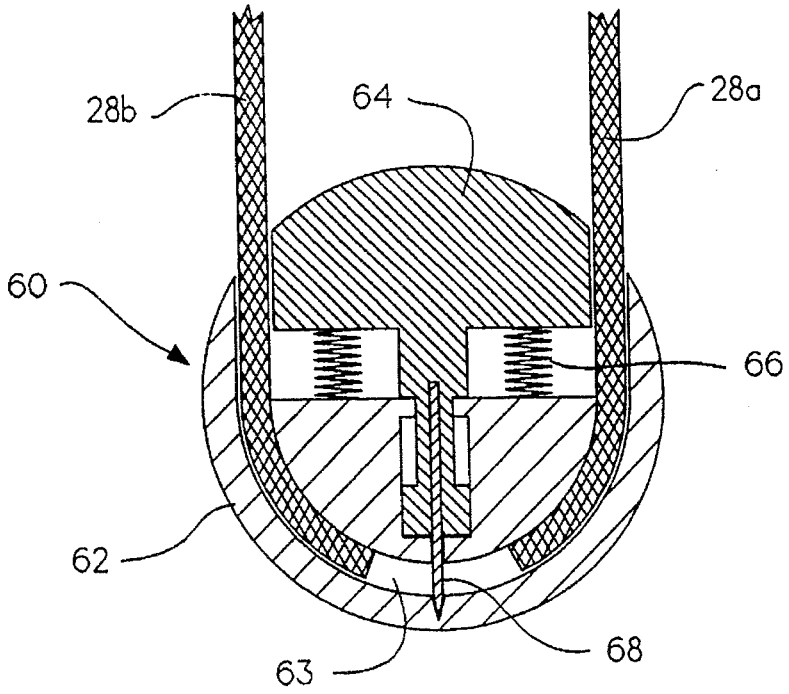
FIG. 9 is a sectional view showing the embodiment of FIG. 8 with the plunger in a depressed position.

As can be seen from the second embodiment shown in FIGS. 8, 9 and 10, the safety device could be disk shaped. This embodiment 60 is comprised of a body 62 and attached cover 61. Within the body 61 are cord channel 63 and anvil 65, plunger 64, spring 66 and blade 68. The cord channel 63 is U-shaped and follows the exterior contours of the main body 62. In this embodiment a single angled blade 68 is used.

Figure 15:
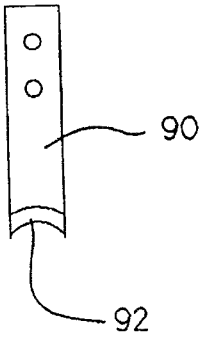
FIG. 15 is a top plan view of an alternative blade which can be used in the safety device.
Figure 14:
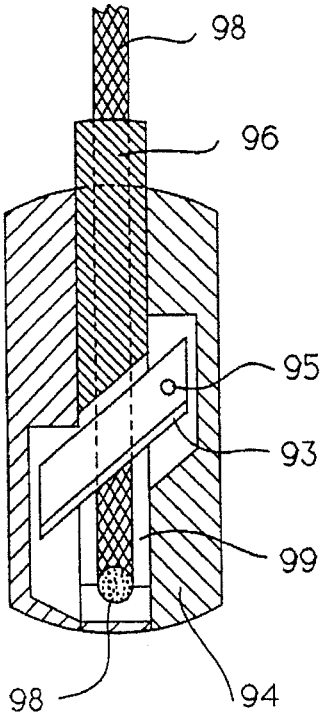
FIG. 14 is a sectional view showing a fourth present preferred embodiment of my safety device.

From FIG. 10 it should be apparent that the blade 68 could be pivotably or otherwise moveably attached to the main body 62 and not attached to the plunger. Such an embodiment is shown in FIG. 14. Although the blades 44 and 68 shown in the first two embodiments are V-shaped or diagonally oriented relative to the cord channel, other blade shapes and orientations could be used. For example, in FIG. 15 a suitable blade 90 having a curved cutting edge 92 is shown.

Figure 11:
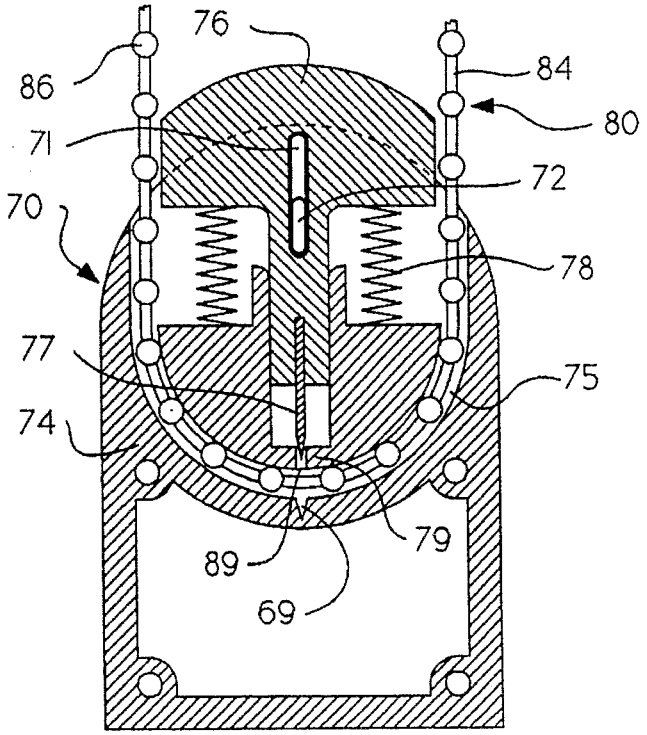
FIG. 11 is a cross-sectional view of a third present preferred embodiment of my safety device with the plunger in an up position.
Figure 12:
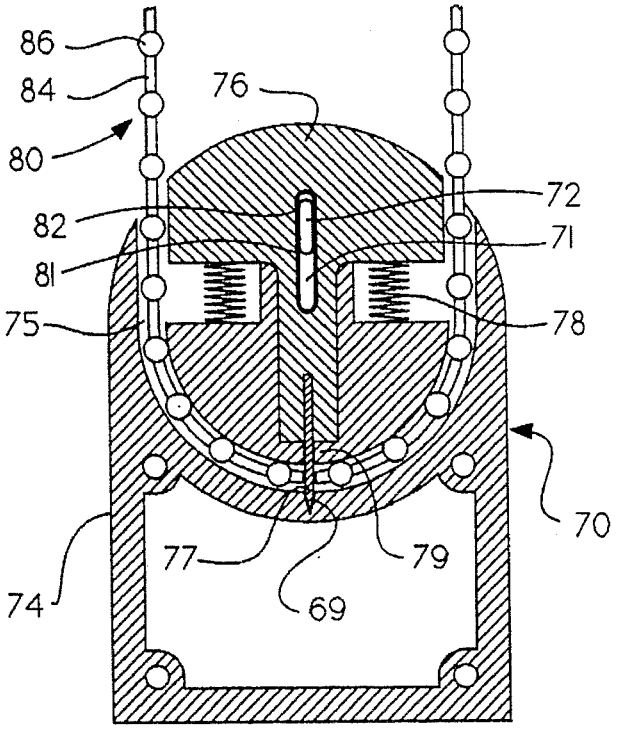
FIG. 12 is a sectional view showing the embodiment of FIG. 11 with the plunger in a depressed position.
Figure 13:
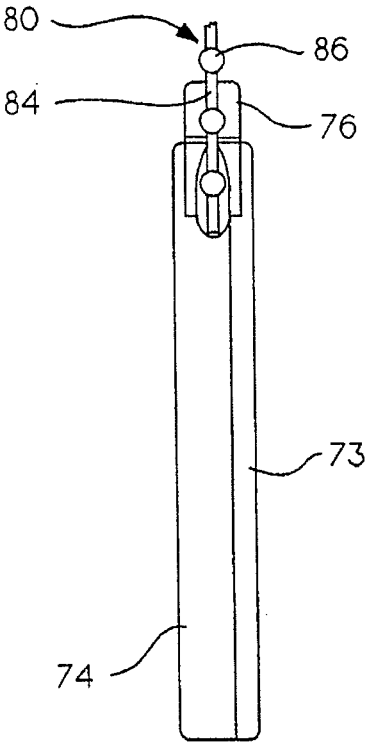
FIG. 13 is a is side view of the embodiment of FIGS. 11 and 12.

Although the first two present preferred embodiments are shown with a woven cord, the safety device could also be used on a beaded chain as shown in FIGS. 11 thru 13. Beaded chain 80 is comprised of a series of plastic beads 86 along a plastic or woven cord 84. The third preferred embodiment shown in FIGS. 11 thru 13 is similar to the other embodiments. There is a main body 74 having a cord channel 75 with slotted anvil 69. Cover 73 is attached to the main body after the beaded cord 80 has been placed in the cord channel 75. A plunger 76 having an attached blade 77 is fitted within the main body 74. I prefer to provide a pin 72 with an enlarged head 82 and slot 71 with a recess 81 to keep the plunger 76 held within the body. The enlarged head prevents removal of the plunger 76 from the body 74. Springs 78 are provided to bias the plunger 76 in an up position. Within the body 74 indexing means 79 are provided adjacent the blade slot 89 to index the beaded chain 80 that passes through the cord channel 75 so that a bead 86 is not adjacent the blade channel 89 whenever the safety device is freely hanging on the beaded chain. Therefore, when the plunger 76 is activated the blade 77 can easily cut the cord portion 84 rather than strike a bead 86.

In the fourth present preferred embodiment shown in FIG. 14, the blade 93 is located within blade cavity 91 and pivotably attached to the body 94 at pivot pin 95. When the plunger 96 is depressed the head 97 of the plunger will push the blade 93 causing it to pivot about pin 95 and cut the cord 98 within cord channel 99.

The fifth present preferred embodiment of my safety device 100 is shown in FIGS. 16 thru 19. This embodiment is comprised of a base 102 and cover 104 which fits over the base. I provide locking tabs 106 for attaching the cover to the base and an alignment boss 108 near each side for ease in assembly. The upper portions of the inner side of the base have contoured faces 109 and 110 which form a portion of the cord channel 111. The base also has a travel pin 112 attached near the upper end of the base. Locking tabs 113 are provided on the travel pin to retain plunger 120 in place. A landing 114 having slots 115 on opposite sides is provided near the travel pin. These notches 115 receive the distal ends of base positioning springs 132 and 133 of the slide assembly 130 shown in FIG. 18. Plunger 120 has a slot 122 through which travel pin 112 extends. I prefer to provide channels 123 and 124 along which tabs 113 may travel. These tabs also serve to lock the plunger 20 on the base 102. The plunger 120 has a leg 12B which extends from the upper body portion 126 of the plunger. Spring acceptance slots 127 and 128 are provided on either side of the leg to receive the ends of plunger positioning springs 134 and 135.

Figure 16:
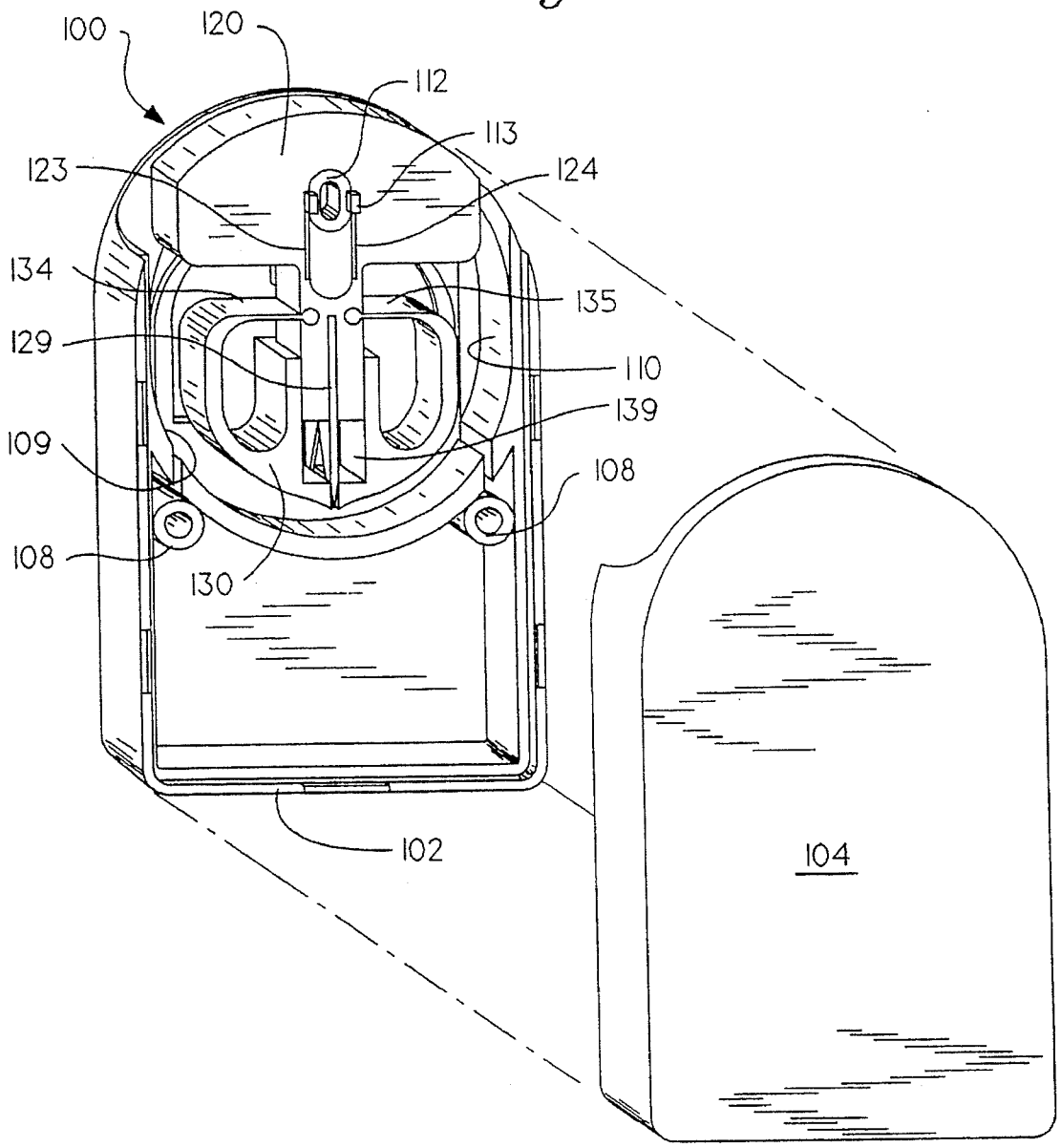
FIG. 16 is a perspective view showing a fifth present preferred embodiment of my safety device with the cover removed.
Figure 17:
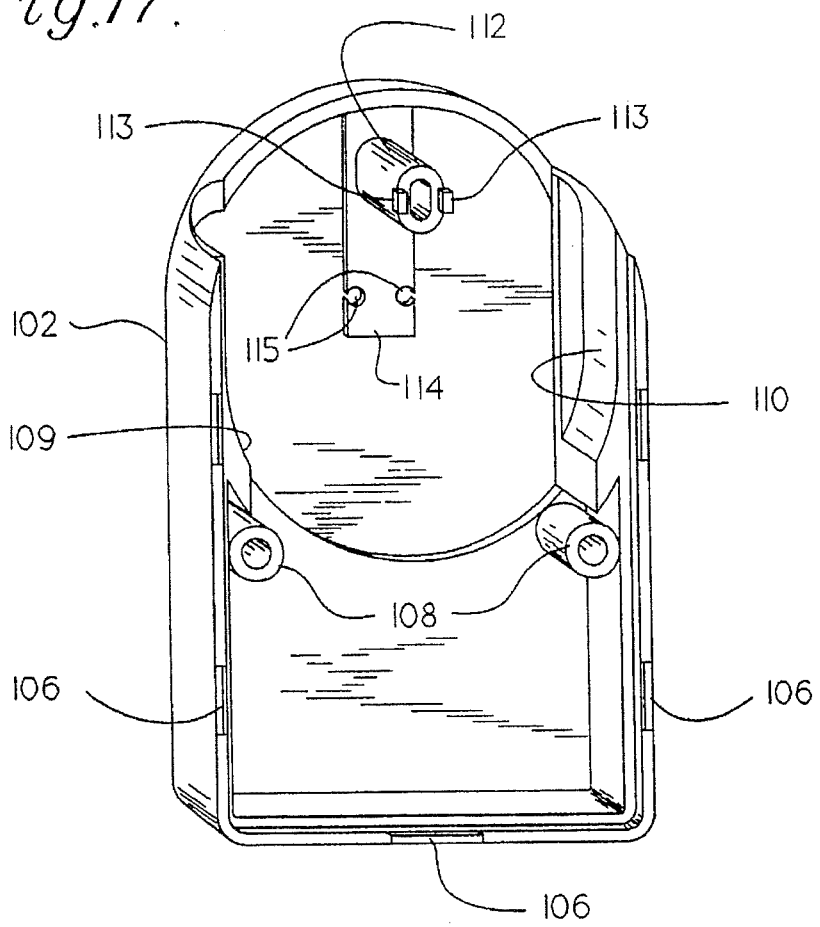
FIG. 17 is a perspective view of the base for the embodiment shown in FIG. 16.
Figure 18:
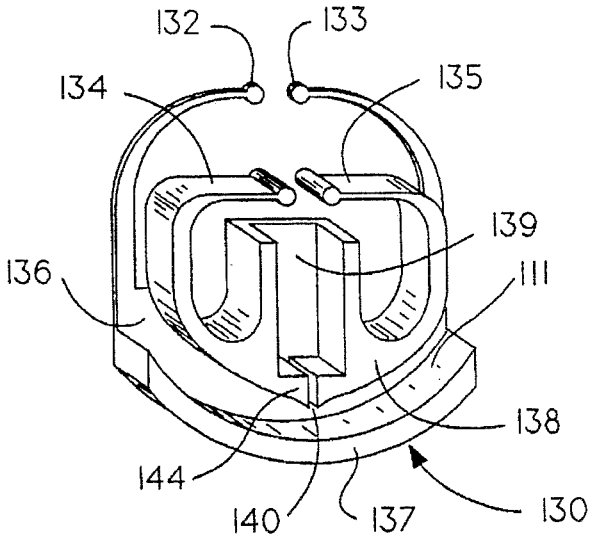
FIG. 18 is a perspective view of the slide assembly for the embodiment shown in FIG. 16.
Figure 19:
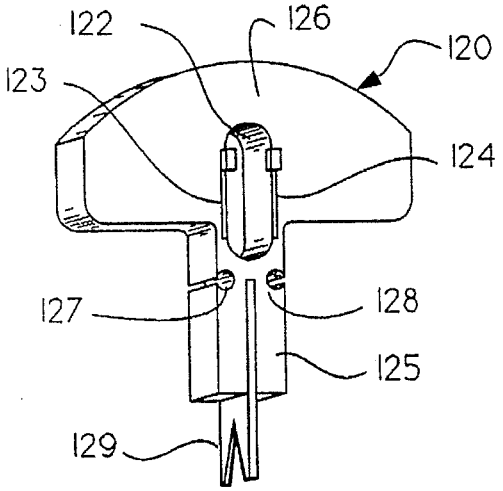
FIG. 19 is a perspective view of the plunger for the embodiment shown in FIG. 16.

The slide assembly 130 shown in FIG. 18 has a base 136 from which base positioning springs 132 and 133 extend. Attached to the base is an anvil 137 and central housing 138. The anvil and central housing are shaped and spaced apart to define a portion of the cord channel 111. The plunger positioning springs 134 and 135 extend from the central housing. Within the central housing there is a plunger guide slot 139 into which the leg 125 of the plunger 120 fits. The central housing also has a blade slot 140 and a cord indexing guide 144. This guide 144 is a rounded projection through which the blade slot 140 passes. In the event that a beaded cord is passed through the cord channel 111, cord indexing guide 144 would cause the cord to be positioned so that the blade slot 140 is aligned between two beads of the beaded chain. The slide assembly is preferably a one piece molded plastic part. When positioned within the base 102 as shown in FIG. 16 the head 126 of plunger 120 fits over base positioning springs 132 and 133 preventing the slide assembly from being removed from the base. When so positioned the blade 129 will be fully contained within the plunger guide channel 139 preventing accidental injuries.

The fifth embodiment would most likely be sold in the form illustrated in FIG. 16. The cover 104 would be separate from the base allowing the buyer to place a cord within cord channel 111. Then, he would place the cover over the base which would be locked in place by locking tabs 106. When so assembled, the safety device would look very much like a cord weight. Thus, the plunger would be less obvious to children thereby reducing the likelihood that a child will play with the device causing the cord to be prematurely cut.

I prefer to use plastic to make the base, cover, plunger and slide assembly of the fifth embodiment and comparable parts of the other embodiments and to make the blade of a corrosion resistant metal. Therefore, if the device is exposed to moisture it would not corrode.

The plastic components are preferably made of molded polycarbonate. The body and plunger are plastic and the spring is a plastic web. If desired, metal filings or other material could be added to the plastic during molding to increase the weight of the device.

While certain present preferred embodiments have been shown and described, it is distinctly understood that the invention is not limited thereto but may be otherwise embodied within the scope of the following claims.

I claim:

1. A safety device for use on at least one cord having a loop therein that passes through a cord channel through the safety device comprising:

a. a base having opposite sides defining a portion of the cord channel, a landing having at least one notch therein sized and positioned to receive an end of a base positioning spring and a travel pin sized and positioned to receive a slot in a plunger;

b. a slide assembly comprised of:

i. a slide assembly base having at least one base positioning spring extending therefrom, the base positioning spring having a distal end fitted within the notch of the landing;

ii. an anvil attached to the slide assembly base;

iii. a central housing attached to the slide assembly base opposite the anvil to define the second portion of the cord channel, the central housing having, at least one plunger positioning spring extending therefrom, a plunger guide slot sized to receive a leg of a plunger, and a blade slot sized and positioned to permit a blade attached to a plunger fitted within the plunger guide slot to enter the cord channel when the leg of the plunger moves through the plunger guide slot toward the cord channel;

c. a plunger having a leg fitted within the plunger guide slot and at least one notch into which a distal end of the at least one plunger positioning spring is fitted, and a slot through which the travel pin extends, the slot being sized to permit the plunger to move relative to the travel pin;

d. a blade attached to the plunger being sized and positioned so that the blade is above the anvil and the plunger can be moved relative to the slide assembly in a manner to pass through the blade slot and cut any cords which are within the cord channel; and e. a cover fitted over the base.

2. The safety device of claim 1 wherein the slide assembly, plunges, base and cover are plastic.

3. The safety device of claim 1 wherein the blade is V-shaped.

4. The safety device of claim 1 also comprising means attached to the central housing of the slide assembly for indexing a beaded cord placed within the cord channel.

5. The safety device of claim 1 wherein the cover and base are separate parts and also comprising locking tabs on the base for attaching the cover to the base.

6. The safety device of claim 1 wherein the base and cover are separate parts and the plunger and base are sized and configured so that the plunger cannot be pulled away from the base after the cover has been placed on the body.

7. The safety device of claim 1, further comprising a weight attached to the body.

8. The safety device of claim 1 wherein the safety device disk-shaped.

* * * * *

UNITED STATES PATENT AND TRADEMARK OFFICE

CERTIFICATE OF CORRECTION

PATENT NO. : 5,553,650

DATED : September 10, 1996

INVENTOR(S) : RALPH JELIC

It is certified that error appears in the above-indentified patent and that said Letters Patent is hereby corrected as shown below:

Column 6, line 50, claim 2, change "plunges" to --plunger--.

Signed and Sealed this

Seventeenth Day of December, 1996

*Attest:*

Bruce Lehman

BRUCE LEHMAN

*Attesting Officer*

*Commissioner of Patents and Trademarks*